US007303687B2

(12) United States Patent
Groth et al.

(10) Patent No.: US 7,303,687 B2
(45) **Date of Patent: *Dec. 4, 2007**

(54) GUTTER LINING METHOD AND INSERT APPARATUS INCORPORATING POROUS NON-WOVEN FIBER MATTING

(76) Inventors: Brian M Groth, c/o Clair, Inc 19611 E. Nine Mile Rd., St Clair Shores, MI (US) 48080; Frank R Groth, c/o Clair, Inc 19611 E. Nine Mile Rd., St Clair Shores, MI (US) 48080

( * ) Notice: Subject to any disclaimer, the term of this patent is extended or adjusted under 35 U.S.C. 154(b) by 115 days.

This patent is subject to a terminal disclaimer.

(21) Appl. No.: 11/180,838

(22) Filed: Jul. 13, 2005

(65) Prior Publication Data

US 2005/0247611 A1 Nov. 10, 2005

Related U.S. Application Data

(63) Continuation-in-part of application No. 10/780,006, filed on Feb. 17, 2004, now Pat. No. 6,932,911.

(60) Provisional application No. 60/448,082, filed on Feb. 18, 2003.

(51) Int. Cl.
*B09C 1/00* (2006.01)

(52) U.S. Cl. ..... 210/747; 210/155; 210/162; 210/496; 210/505; 52/12; 52/745.19

(58) Field of Classification Search ..... 210/747, 210/162, 474, 496, 505, 155, 335, 489; 52/11, 52/12, 14, 16, 741.1, 745.19
See application file for complete search history.

(56) References Cited

U.S. PATENT DOCUMENTS

| | | | | |
|---|---|---|---|---|
| 2,988,226 | A * | 6/1961 | Campbell | 210/474 |
| 3,436,878 | A * | 4/1969 | Singer | 52/12 |
| 3,507,396 | A | 4/1970 | Ramsay | |
| 3,855,132 | A | 12/1974 | Dugan | |
| 5,103,601 | A | 4/1992 | Hunt | |
| 5,107,635 | A | 4/1992 | Carpenter | |
| 5,167,579 | A | 12/1992 | Rotter | |
| 5,242,591 | A | 9/1993 | Beechart et al. | |
| 5,459,965 | A * | 10/1995 | Meckstroth | 210/474 |
| 5,592,783 | A | 1/1997 | Jones | |
| 5,595,027 | A | 1/1997 | Vail | |

(Continued)

*Primary Examiner*—Christopher Upton
(74) *Attorney, Agent, or Firm*—Carrier, Blackman & Associates, P.C.; William D. Blackman; Joseph P. Carrier

(57) ABSTRACT

An insert apparatus for placement in a rain gutter includes a porous insert body including a plurality of randomly arranged filaments attached to one another to form a mat. The insert apparatus is shaped to fit within an inside channel of a rain gutter. Optionally, the apparatus may include a cover panel, comprising a screen, attached to the top of the insert body. Additionally, the apparatus may include a panel provided with holes therethrough, covering the screen panel. In use, the insert apparatus is placed inside of the gutter channel so as to substantially fill part of the channel, blocking entry of debris into the gutter. When placed in the gutter channel, the insert apparatus substantially prevents foreign matter such as leaves, twigs, pine needles, etc, from collecting in the channel. The insert apparatus may be configured to leave an open flow path therebelow when installed in the gutter.

22 Claims, 9 Drawing Sheets

U.S. PATENT DOCUMENTS 5,632,888 A 5/1997 Chinn et al.
5,848,857 A 12/1998 Killworth et al.
5,960,590 A 10/1999 Hutchison
6,016,631 A * 1/2000 Lowrie, III ..... 52/12
6,134,843 A 10/2000 Tregear
6,161,338 A * 12/2000 Kuhns ..... 210/474
6,193,880 B1 2/2001 Bergeron
6,202,357 B1 * 3/2001 Spradlin ..... 52/12
6,349,506 B1 * 2/2002 Pace et al. ..... 52/12
6,463,700 B2 * 10/2002 Davis ..... 52/12
2002/0100223 A1 * 8/2002 Brochu ..... 52/12
2002/0166290 A1 * 11/2002 Bergeron ..... 52/12

* cited by examiner

GUTTER LINING METHOD AND INSERT APPARATUS INCORPORATING POROUS NON-WOVEN FIBER MATTING

CROSS-REFERENCE TO RELATED APPLICATIONS

This application is a Continuation-in-Part of U.S. patent application Ser. No. 10/780,006, filed Feb. 17, 2004 now U.S. Pat. No. 6,932,911, which in turn, claimed priority under 35 USC 119 (e), based on U.S. provisional patent application Ser. No. 60/448,082, filed Feb. 18, 2003. The entire disclosure of U.S. patent application Ser. No. 10/780,006 is hereby incorporated by reference.

BACKGROUND OF THE INVENTION

1. Field of the Invention

The present invention relates to a porous gutter insert apparatus, and to a method of lining a gutter therewith. More particularly, the present invention relates to a gutter insert apparatus including a non-woven porous fiber matting, and to a method of using the insert apparatus to line a rain gutter, in order to resist accumulation of leaves, sticks and other debris therein.

2. Description of the Background Art

A number of different devices are known for protectively covering rain gutters, to keep leaves and debris from accumulating inside of the gutters. Examples of some of the known devices are described in U.S. Pat. No. 3,855,132 to Dugan, U.S. Pat. No. 4,949,514 to Weller, U.S. Pat. No. 5,103,601 to Hunt, U.S. Pat. No. 5,242,591 to Beechert, U.S. Pat. No. 5,592,783 to Jones, U.S. Pat. No. 5,848,857 to Killworth et al., and U.S. Pat. No. 6,134,843 to Tregear.

A number of commercial products are also available for screening or protecting rain gutters, including Cinch™ Gutter Guards from GutterTop Solutions of Dayton, Ohio, Gutter Topper™ from GutterTopper LTD, of Amelia, Ohio, Gutter Helmet™ from American Metal Products of Dayton, Ohio, the Hallett™ Gutter Cover from Hallett Enterprises of Crawfordsville, Ind., The Wedge™ downspout screen from Avlis Products of Templeton, Calif., and Flo-Free™ Gutter Inserts from D.C.I. Company of Clifton Heights, Pa.

A roof vent apparatus including a low-restriction synthetic fiber mat is disclosed in U.S. Pat. No. 5,167,579 to Rotter.

Although the known devices have some utility for their intended purposes, a need still exists in the art for an improved gutter-protecting method and insert apparatus for preventing debris from accumulating in gutters. In particular, there is a need for an improved gutter-protecting insert apparatus, which is easy to install, which is long-lasting, and which allows water to flow therethrough, while keeping the majority of debris out.

SUMMARY OF THE INVENTION

The present invention provides an insert apparatus for placement in a rain gutter. An insert apparatus according to a first illustrative embodiment of the invention includes an insert body made of a lightweight non-absorbent, porous material, shaped to fit within an inside channel of a rain gutter. Optionally, the apparatus may include a cover panel, comprising a screen, attached to the top of the insert body. Additionally, the apparatus may include an optional panel installed to cover the insert body and attached screen panel.

In use, the insert apparatus is placed inside of the gutter channel so as to substantially fill part of the channel, and to block entry of debris into the gutter. When placed in the gutter channel, the insert apparatus substantially prevents foreign matter such as leaves, twigs, pine needles, etc, from collecting in the channel.

Optionally, the insert apparatus may be configured to leave an open flow path therebelow when installed in the gutter.

The insert apparatus according to the invention may be configured to completely fill the gutter channel. Alternatively, the insert apparatus may be formed with one or more major voids formed therein along a selected surface thereof; or may be configured to fill only a portion of the gutter channel, leaving an unobstructed and open path for water to flow through, outside of the insert within the gutter channel.

The porous material is selected such that water is able to flow easily through the interstices between the fibers thereof, while leaves, sticks and similar large items are retained on the upper surface of the insert, and will eventually blow or fall off.

Since the insert apparatus according to the present invention is formed of a lightweight, flexible material, the gutter insert is easily placed into the gutter channel, even by a novice, and using no extra tools or fastening means. In order to be substantially undetectable from the ground level, the insert hereof may be dimensioned so that the upper surface is flush with, or closely spaced near the top edge of the rain gutter.

The insert apparatus according to the invention is relatively lightweight and somewhat pliable, yet may be dense enough so that it does not float in rainwater collected in the gutter.

While the inward-facing surfaces of the insert apparatus hereof may have a rough surface, the upper face of the insert may be made somewhat denser than the rest of the insert. The upper face of the insert also may have a cover sheet attached to the top of the insert body in order to sustain the insert apparatus as a single piece that fits conveniently into the gutter.

The cover sheet may also have a solid cover panel attached thereto in order to provide to provide a relatively smooth surface, such that when debris on top of the insert dries out, natural causes (i.e. wind, gravity, animals, etc.) will allow the insert to easily self-clean. The solid cover panel may have a pattern of holes cut therein at a top surface such that water may pass properly therethrough into the gutter channel. The solid cover panel may also include grooves thereon that form easily removable openings for accommodating gutters having protruding fasteners and their associated protective sleeves and the like.

The present invention also encompasses a method of lining a gutter with a porous gutter insert, including a step of placing an elongated insert into a gutter channel in a manner so that when installed, the insert contacts the gutter on at least three sides of the insert, to cover the channel and to substantially fill part of the channel.

The placement of the insert hereof into a gutter may leave an open water flow passage outside of the apparatus in the gutter channel. The insert used in the method hereof is the insert described herein, and includes a porous non-woven matting. The placement step may, optionally, involve sliding the insert below the gutter's mounting nails' protective sleeves. The method also includes a step of placing an outermost top edge of the insert below an upper inwardly facing lip of the gutter.

Further, the method includes a step of placing an elongated solid cover panel, provided with holes and grooves, into the gutter channel above the insert. The method further includes a step of placing an outwardly facing lip at the outermost edge of the solid cover panel below the upper inwardly facing lip of the gutter.

Accordingly, it is an object of the present invention to provide a method and apparatus for protecting rain gutters from accumulating debris therein.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION

Figure 1:
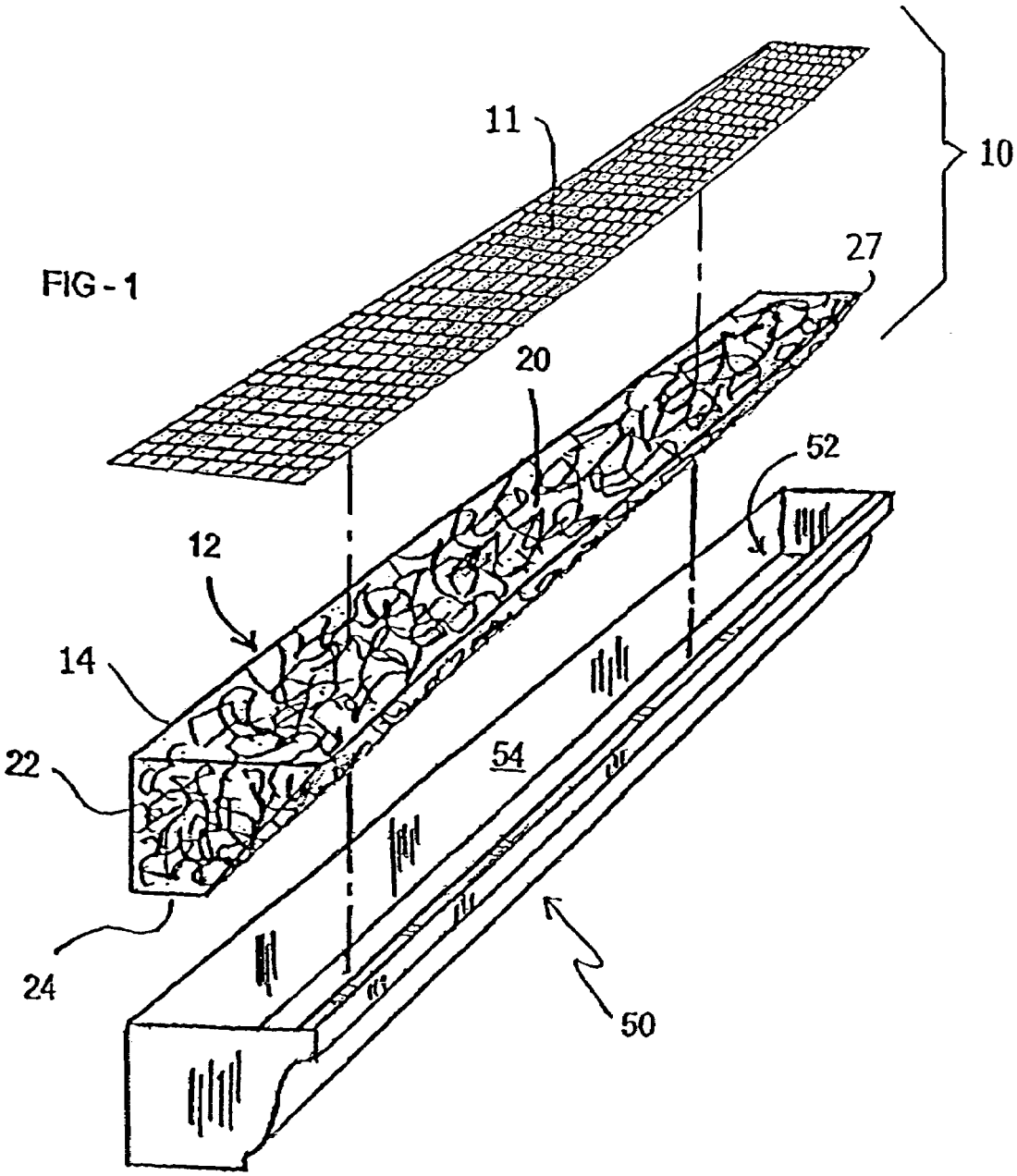
FIG. 1 is an exploded perspective view of a gutter and an insert apparatus therefor according to a first illustrative embodiment of the invention.
Figure 2:
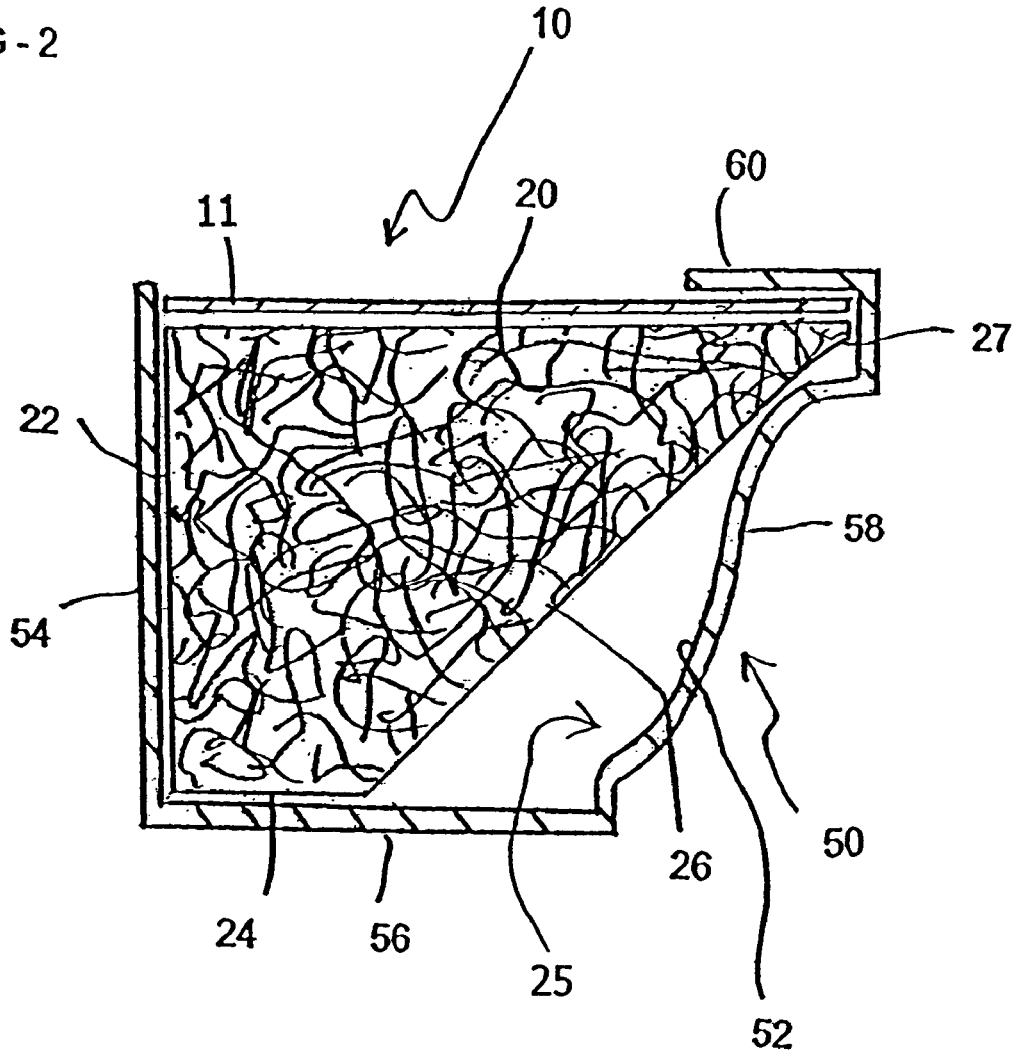
FIG. 2 is a cross-sectional view of the gutter and insert apparatus of FIG. 1, with the insert apparatus shown installed in the gutter.

Referring now to FIGS. 1-2, an insert apparatus according to a first illustrative embodiment of the invention is shown generally at 10, along with a gutter 50 in which the insert fits. The insert apparatus 10 is shaped to fit within an inside channel of a rain gutter 50.

In use, the insert apparatus is placed inside of the gutter channel 52 within the gutter 50 so as to substantially fill part of the channel, and to block entry of debris into the gutter. When placed in the gutter channel 52, the insert apparatus substantially prevents foreign matter such as leaves, twigs, pine needles, etc, from collecting in the channel.

The insert 10 includes an elongated insert body 12 adapted to fit into a hollow channel 52 of a gutter 50, and to contact the gutter 50 with at least three surfaces thereof, when placed therein. The insert apparatus 10 may also include a cover sheet 11 made of smooth flexible material, preferably made of plastic.

In the embodiment of FIGS. 1-2, the cover sheet 11 is disposed on top of the insert body 12, and is attached thereto.

Figure 3A:
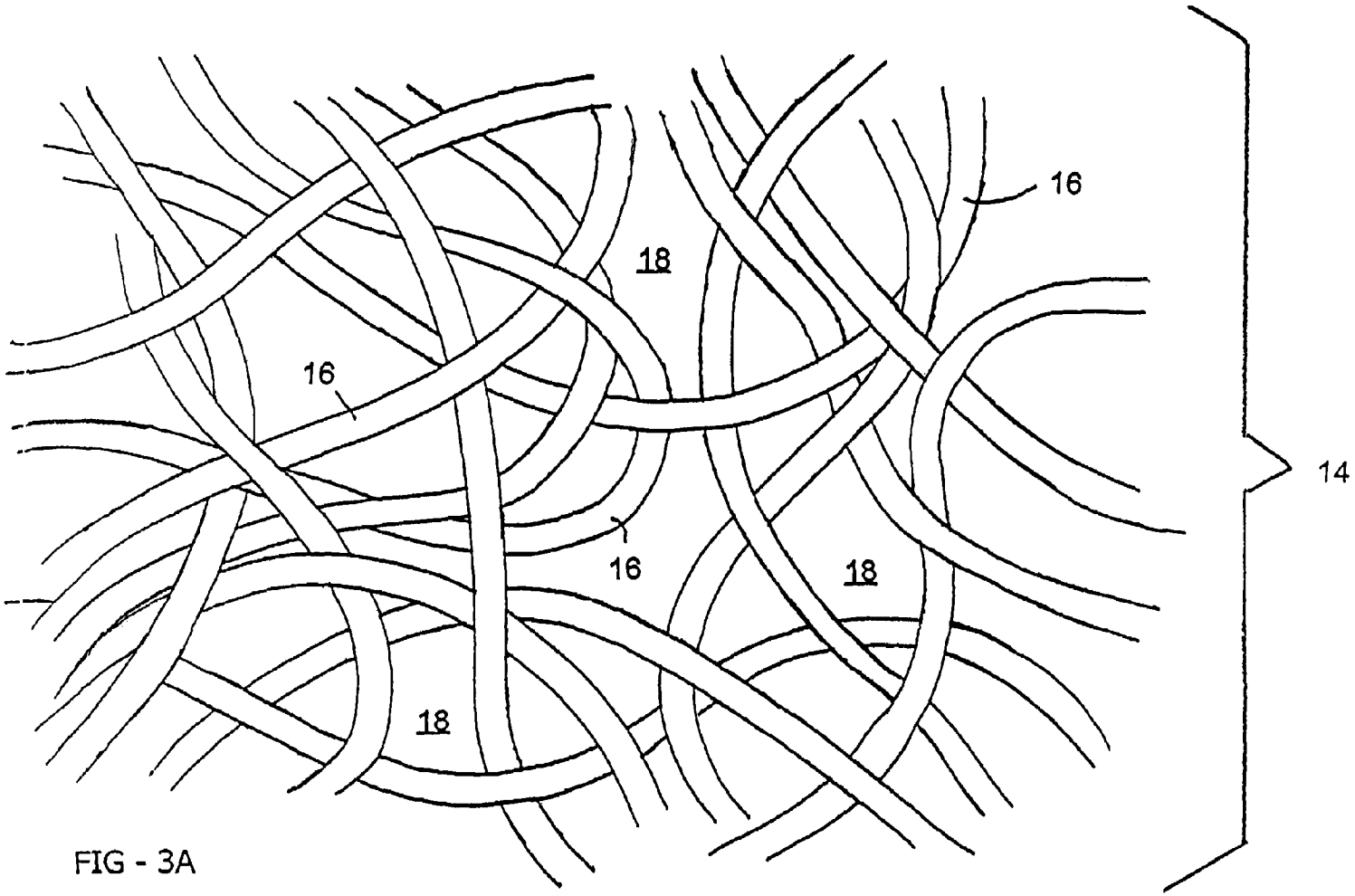
FIG. 3A is a detail view of the structure of the insert body of FIG. 1 showing a first material usable to form the insert body.

The insert body 12 is preferably a thick mat 14 formed from a nonwoven material made up of a plurality of randomly oriented and interconnected fibers or filaments 16 (FIG. 3A). The filaments 16 have open interstices 18 defined therebetween, with a binder affixing selected areas of the filaments to one another at the points of contact therebetween.

Figure 3B:
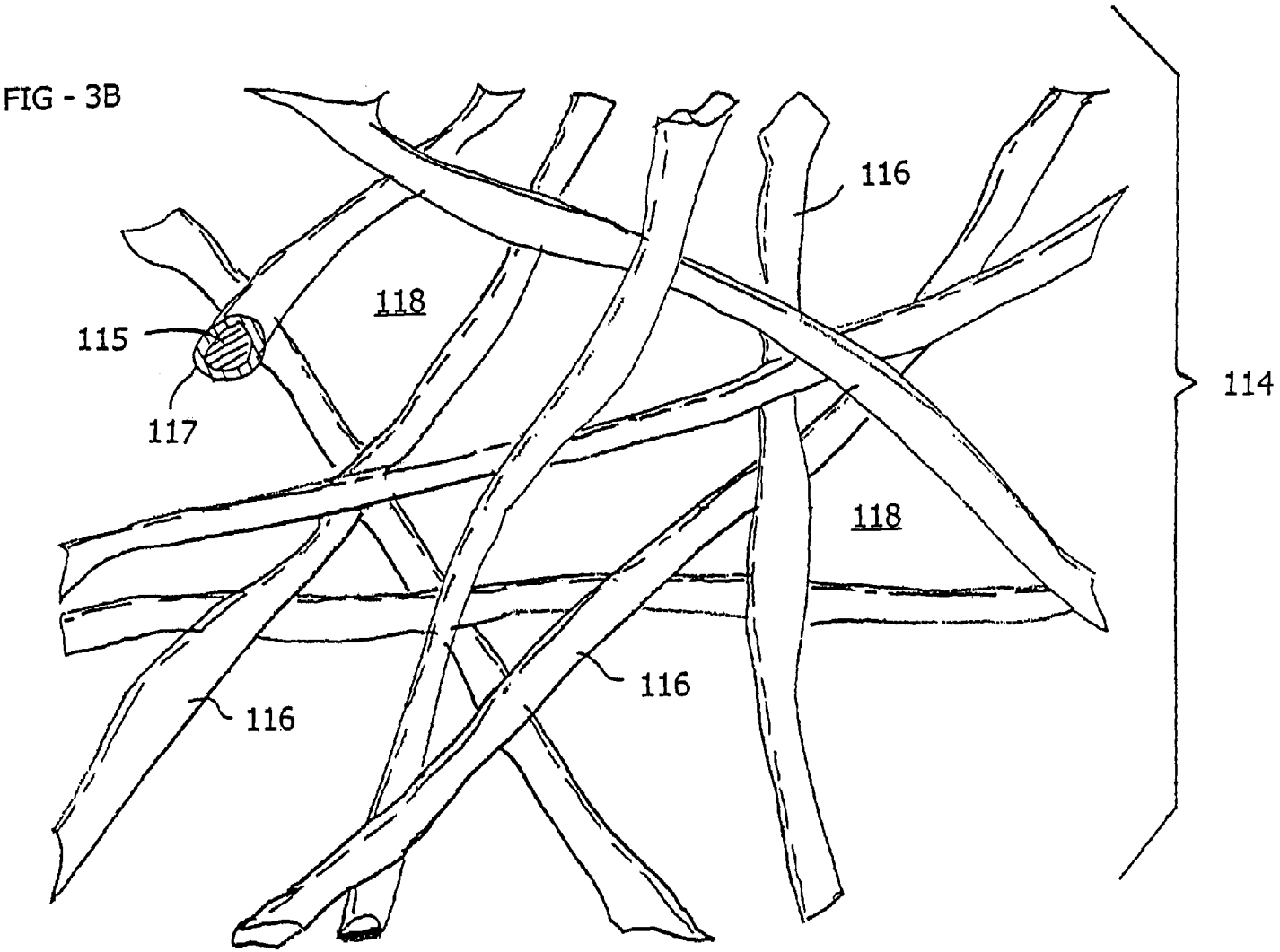
FIG. 3B is a detail view, showing an alternative structure for the insert body of FIG. 1, in which the body is formed from a second material.

As seen in FIG. 3B, a second, alternative material for the mat may include a plurality of filaments 116 arranged in random order to form a porous mat 114. Each filament 116 in this second embodiment is made up of a central core 115 made of a natural fiber, and a binder forming a coating 117 on the outer surface of the core.

The insert body 12 is configured to match the dimensions of the gutter 50 in which it is intended to be used, and therefore can be made in different sizes to match the dimensions of different gutters.

However, the insert body 12 is preferred to be at least three inches in height, and may be made between three and seven inches in height, for a standard residential application. The insert body 12 may be formed from two or more stacked layers of material, which may be glued together.

The insert body 12 has an upper surface 20, an inner side wall 22 for placement contacting an inner wall 54 of the gutter channel 52, a bottom surface 24 for resting on the floor 56 of the gutter channel, and an outer side wall 26, for placement facing towards an outer wall 58 of the gutter 50. The outer side wall 26 slants outwardly as it moves up from the bottom surface 24. Where the outer side wall 26 meets the top face 20, it forms an angled outermost top edge 27 adapted to fit engagingly below an upper inwardly facing lip 60 of the gutter 50. In order to be substantially undetectable from the ground level, the insert hereof may be dimensioned so that when installed in a gutter, the upper surface is flush with, or closely spaced near the top edge of the rain gutter.

The porous material of the mat 14 or 114 is selected such that water is able to flow easily through the interstices thereof, while leaves, sticks and similar large items are retained on the upper surface 20 of the cover sheet 11, from which the debris will eventually blow or fall off.

Since the insert apparatus 10 according to the present invention is formed of a lightweight, flexible material, the insert is easily placed into the gutter channel 52, even by a novice, and using no extra tools or fastening means. No caulking, fastening or gluing is required, since the insert 10 is held in place by the mounting nails and protective sleeves, and/or by the inwardly extending lip 60 of the gutter, which are all located above the insert in the finished installation. Therefore, installation of the protective insert 10 hereof is much quicker than installation of other gutter protection devices. This easy and quick installation means that the final cost to the homeowner will be less than the cost of some other gutter protection devices.

The insert apparatus 10 may also be installed into gutters 50 in new construction before the gutters are mounted on their buildings, and this helps to give form and solidity to the gutters, thereby aiding the installer and facilitating the installation process.

The insert apparatus 10 according to the invention is relatively lightweight and relatively pliable, yet may be made dense enough that it does not float in rainwater.

While the inward-facing surfaces of the insert apparatus 10 hereof may be formed with a rough exterior surface texture, the upper surface 20 of the insert may be made somewhat denser than the rest of the insert. The upper surface 20 of the cover sheet 11, where used, also has a relatively smooth surface, such that when debris which has been left on the top of the insert apparatus dries out, natural causes (i.e. wind, gravity, animals, etc.) will allow the insert to easily self-clean. Furthermore, the upper surface 20 of the cover sheet 11 serves as a wall maintaining a relatively perpendicular shape of the porous material of the mat 14, 114.

In a first embodiment of the present invention, the mat 14 or 114 making up the insert body 12 may be made of non-woven fiber matting, of a type that has been used in applications for automotive air vent filter material, and which is formed from a mixture of materials comprising some natural materials.

One example of a natural material which may be used to form the mat 14, in the first embodiment hereof, is a composite air-laid nonwoven matting made with 60 weight percent coconut husk fibers with 40 weight percent hot melt latex binder, and with a synthetic flexible material attached to the mat. This material is commercially available from the Blocksom Company of Michigan City, Ind.

Without wishing to be bound by any theory, it is believed that coconut husk fiber is a naturally durable and long-lasting material, and that coating it with a latex binder will increase the longevity thereof, so that even though this embodiment includes a large percentage of plant-based material, it remains dry most of the time, and the latex binder coats and protects the fibers, so accordingly, the product should last for a significant amount of time, in a given application in a gutter.

In a second embodiment of the present invention, the mat 14 making up the insert body 12 may be made of non-woven synthetic fiber mesh, of a type that has been used in other applications for scrubbers and polishers, and also for roof vent filter material.

In forming the mat 14 using the material of the second embodiment, synthetic fibers (usually nylon and/or polyester) are chopped into medium-length segments and blended, and are then randomly aligned into a web by airflow. The web is then treated with binding agents, which may include water-based phenolics and/or latexes. The treated web is then oven-cured to bind the fibers into a relatively rigid mat 14 having a significant porous area between the random fibers 16 thereof.

An example of such a non-woven synthetic fiber mat material, which can be purchased on the open market, is M29 polyester scrubber pads made by Loren Products Division of Atochem North America Inc., with the fibers in the Loren scrubber pads being somewhat denser and more tightly packed than in the application of the present invention. Another material of similar structure is disclosed in U.S. Pat. No. 5,167,579 to Rotter, the disclosure of which is hereby incorporated by reference. The Rotter '579 patent relates to a vent apparatus for a roof.

Referring now to FIG. 2, it will be seen that when the insert 10 according to the first embodiment is installed inside of a gutter 50, the insert substantially fills a back portion of the gutter channel 52, with respective outer wall parts 22, 24, of the insert 10 contacting the back wall 54 and floor 56 of the gutter channel. In addition, part of the outer wall 26 of the insert body 12 rests on part of the outer gutter wall 58 and, as noted, the outermost top edge 27 of the insert fits engagingly below the upper, inwardly facing lip 60 of the gutter 50, to retain the insert in place in the gutter 50. The insert body 12 is configured and dimensioned so that the lower part of the front wall 26 thereof is spaced rearwardly away from the outer wall 52 of the gutter, to provide a passage 25 on the outside of the insert body 12, to allow water to flow freely and unobstructedly through the gutter channel 52.

SECOND EMBODIMENT

Figure 4:
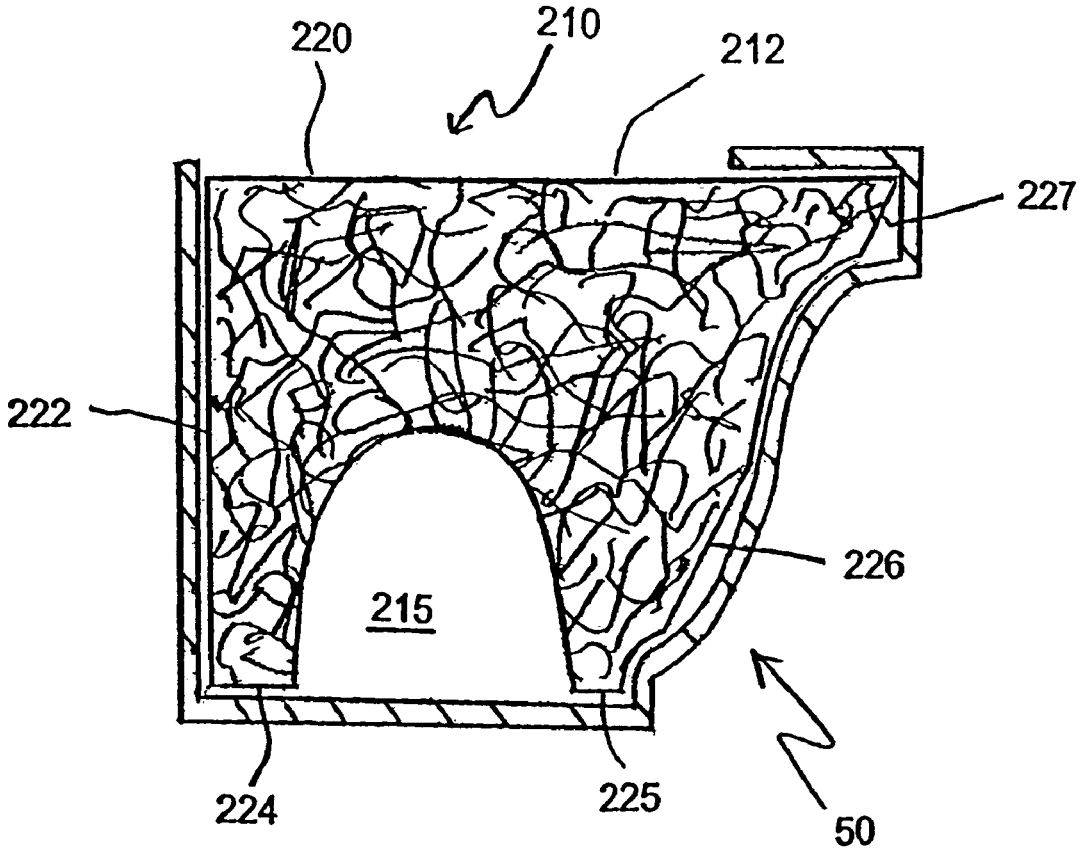
FIG. 4 is a transverse cross-sectional view of a gutter and insert apparatus according to a second illustrative embodiment of the invention.

Referring now to FIG. 4, an insert 210 according to a second embodiment of the invention is shown installed in a gutter 50. The insert 210 according to this second embodiment is similar to the insert 10 of the first embodiment as previously described, except as specifically described as different herein.

The insert body 212 in the second embodiment of the invention has an upper surface 220, an inner side wall 222 for placement contacting an inner wall 54 of the gutter channel 52, a bottom surface 224 for resting on the floor 56 of the gutter channel, and an outer side wall 226, for placement contacting an outer wall 58 of the gutter 50. The outer side wall 226 slants outwardly as it moves up from the bottom surface 224. Where the outer side wall 226 meets the top face 220, it forms an angled outermost top edge 227 adapted to fit engagingly below an upper inwardly facing lip 60 of the gutter 50.

The insert 210 of the second embodiment has been modified from the insert 10 of the first embodiment by hollowing out one or more major void spaces 215 in a selected surface thereof. The term "major void spaces" is used herein to describe open voids which are larger than, and separate from the interstices 18 between the filaments 16 making up the insert body 212.

The void space 215 may be a single hollow groove that is formed in the bottom surface 224 or in another selected surface of the insert body 212, and which extends substantially the entire length of the insert body. The major groove defines an unobstructed pathway to allow water to flow outwardly in the gutter.

Figure 5:
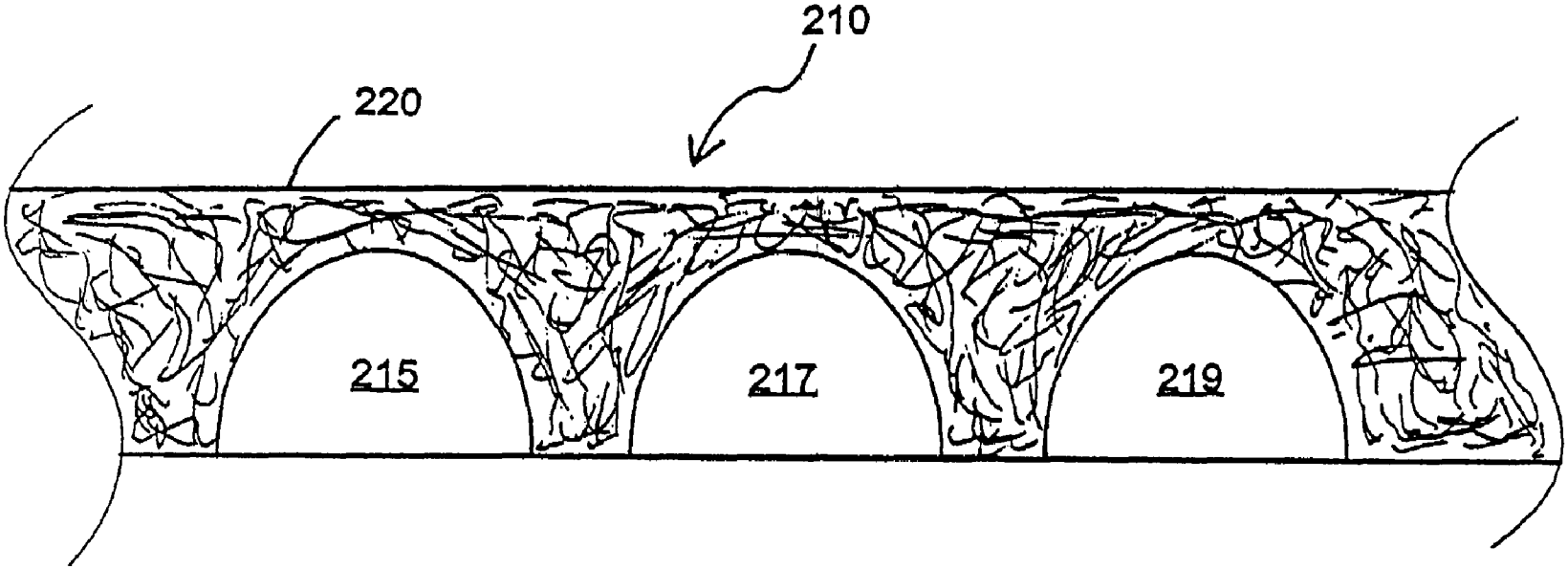
FIG. 5 is a longitudinal cross-sectional view of the insert apparatus of FIG. 4.

Alternatively, the void space 215 may be a series of spaced apart openings 215, 217, 219 formed in the insert body 212, as shown in FIG. 5.

THIRD EMBODIMENT

Figure 6:
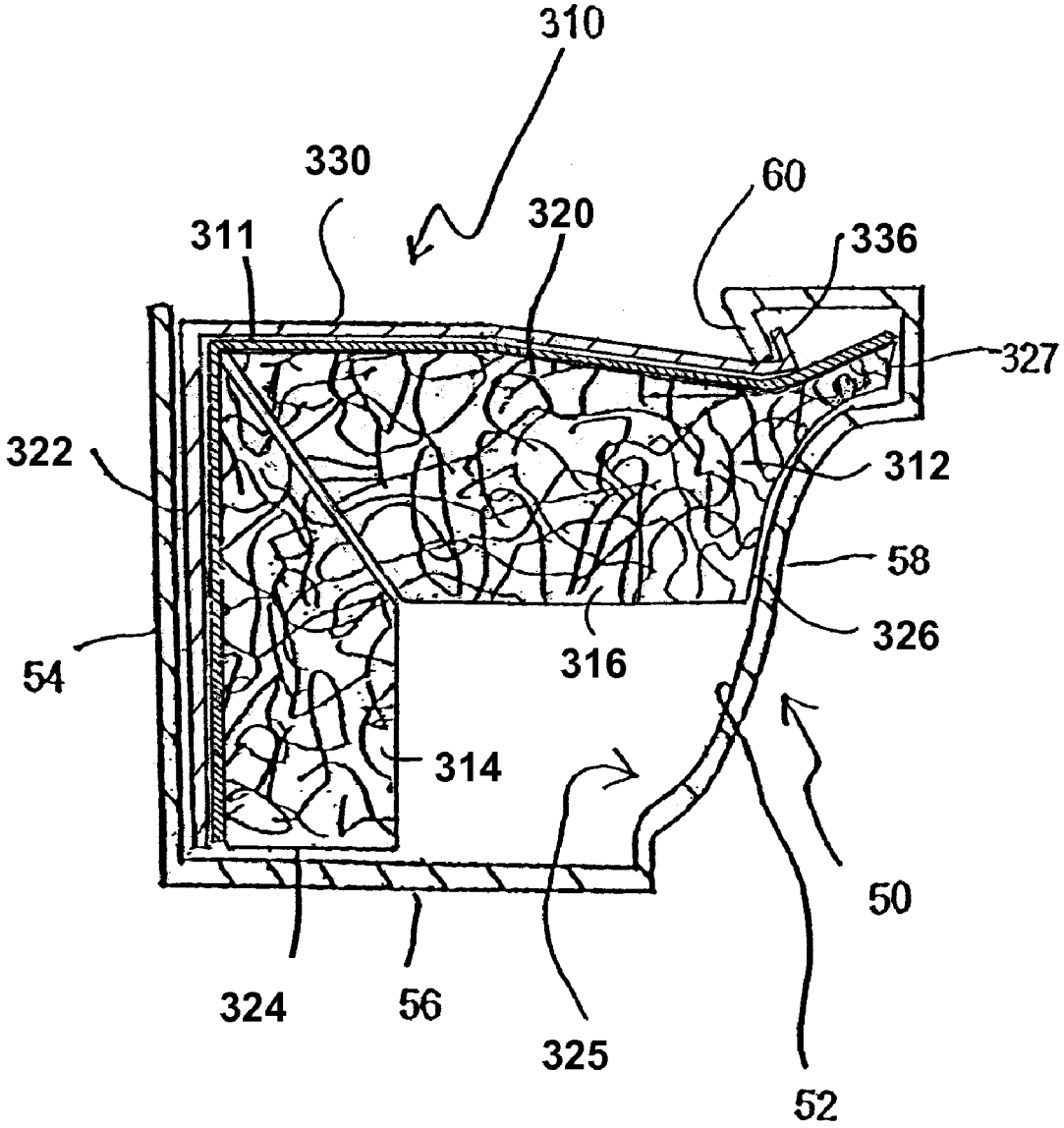
FIG. 6 is a cross-sectional view of the gutter and insert apparatus according to a third illustrative embodiment of the invention, with the insert apparatus shown installed in the gutter.

Referring to FIG. 6, an insert 310 according to a third embodiment of the invention is shown installed in a gutter 50. The insert 310 according to this third embodiment is similar to the inserts 10 and 210 of the first and second embodiment respectively as previously described, except as specifically described as different herein.

Figure 7A:
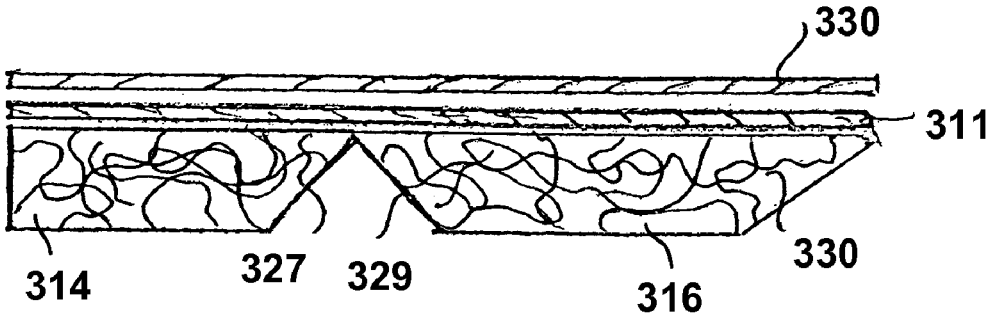
FIG. 7A is a detail view of the insert apparatus of FIG. 6, prior to installation into the gutter, showing the cover sheet, the solid cover panel and the angles surfaces of the insert body.
Figure 7B:
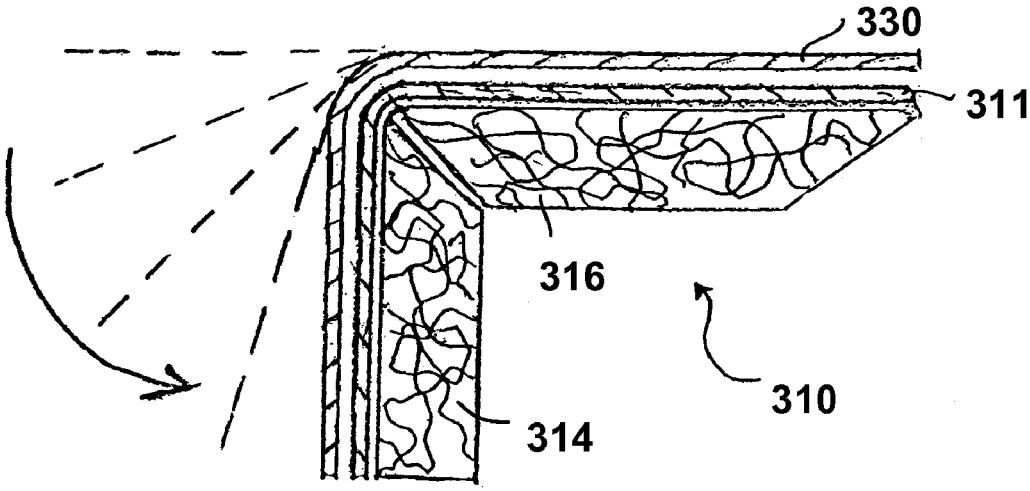
FIG. 7B is a detail view of the insert apparatus of FIG. 6 showing the insert body in a position ready for installation.

The insert 310, in the third embodiment of the invention, includes a two-part insert body 312 including first and second insert sections 314, 316 and a cover sheet 311 interconnecting the two sections of the insert body. The insert body 312 in the third embodiment of the invention may be made according to the embodiments shown in either FIG. 3A or 3B. The insert body 312 is made with adjacent surfaces 327, 329 of the first and second insert sections 314, 316 cut at an angle, and configured to permit pivotal folding of the insert 310 into a substantially L-shaped configuration as seen in end view or in cross-section, with the cover sheet 311 acting as a flexible hinge, as shown in FIGS. 7A-7B. When the insert 310 is installed in a gutter 50 (FIG. 6), the insert body 312 is oriented in the substantially L-shaped configuration, as shown, and has an upper surface 320 for placement contacting the cover sheet 311, an inner side wall 322 for placement next to an inner wall 54 of the gutter channel 52, a bottom surface 324 for resting on the floor 56 of the gutter channel, and an outer side wall 326, for placement contacting an outer wall 58 of the gutter 50.

The insert 310 of the third embodiment has been modified from inserts 10 and 210 of the first and second embodiments respectively by adding a cover sheet 311 that is thin, porous, and flexible and attaches to the insert body 312, as shown in FIG. 7A. Additionally, the channel 325 is relatively large in relation to the embodiments shown in FIGS. 1-5.

Furthermore, above this cover sheet 311 a solid cover panel 330 may, optionally, be operatively attached thereto. The solid cover panel 330, where used, is bent causing the insert body 312 and attached cover sheet 311 to curve pressing two angled surfaces 327, 329 in the insert body 312 against each other, as shown in FIG. 7B.

Figure 8:
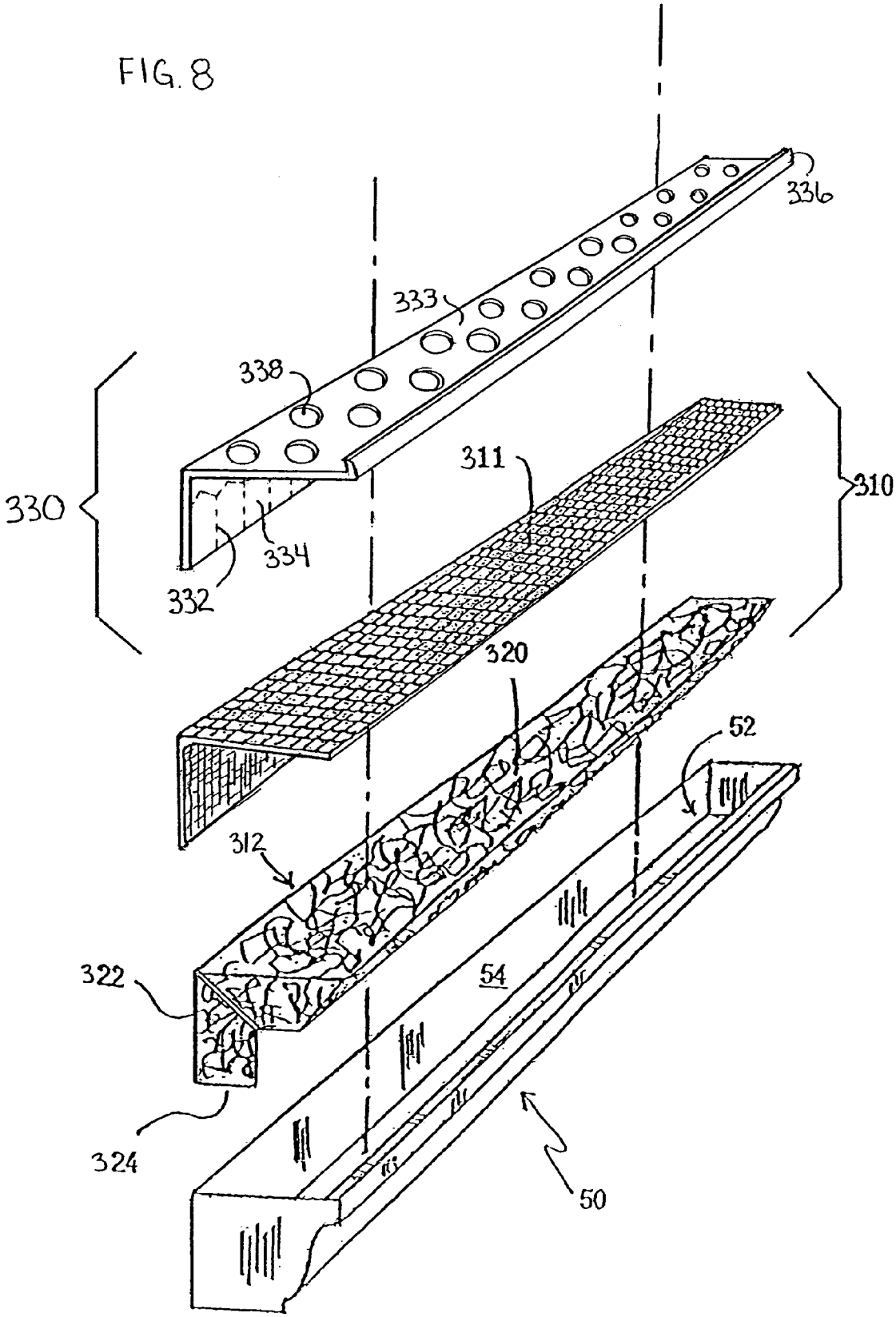
FIG. 8 is an exploded perspective view of a gutter and an insert apparatus therefor according to a third embodiment of the present invention.

The solid cover panel 330, where used, is preferably made of plastic and provided with grooves 332, as shown in FIG. 8, such that a small amount of force will result in easy removal of cutouts 334 formed in the solid cover panel 330 by the grooves 332. These cutouts 334 will decrease difficulty of installation due to nails and the protective sleeves that generally accompany these nails.

The solid cover panel 330 will also be provided with an outwardly extending lip 336 provided to contact the inwardly extending lip 60 of the gutter 50 maintaining the insert 310 and solid cover panel 330 in the gutter channel 52.

Further, the solid cover panel 330 will have a pattern of holes 338 cut into the upwardly facing surface 333 such that water can properly pass therethrough into the gutter channel 52.

Method of Use

The present invention also encompasses a method of lining a gutter 50 with a porous gutter insert 10, comprising a step of placing an elongated insert into a gutter channel 52 to contact the gutter on at least three sides of the insert and to cover the channel and substantially fill part of the channel, while leaving an open water flow passage in the channel outside of the apparatus, wherein the insert includes a porous non-woven fiber matting. Optionally, the placement step may involve sliding the insert 10 below the mounting nails' protective sleeves (not shown). The method also includes a step of placing an outermost top edge 27 of the insert 10 below an upper inwardly facing lip 60 of the gutter 50.

Further, the method may include a step of placing a solid cover panel 330 over the insert body 312 and bending the solid cover panel 330 such that the insert body 312 and attached cover sheet 311 curve to form an edge extending outwardly in each direction. The method further includes a step of placing the outwardly extending lip 336 below the inwardly extending lip 60 of the gutter. The step of placing the solid cover panel 330 over the insert may include removing cutouts 334 in the solid cover panel 330 formed by grooves 332 thereon, to coincide with extruding nails and their respective protective sleeves.

Although the present invention has been described herein with respect to a limited number of presently preferred embodiments, the foregoing description is intended to be illustrative, and not restrictive. Those skilled in the art will realize that many modifications of the preferred embodiment could be made which would be operable. All such modifications, which are within the scope of the claims, are intended to be within the scope and spirit of the present invention.

The invention claimed is:

1. An insert apparatus for use with a rain gutter, said apparatus comprising:

an elongated insert body adapted to fit into a hollow channel of a gutter, and to contact the floor of the gutter when placed therein, said insert body comprising a first insert section, a second insert section, and a cover sheet attached to and interconnecting the first and second insert sections, said cover sheet formed of a bendable porous material, wherein each of said first and second insert sections comprises a nonwoven mat comprising a plurality of filaments having open interstices defined therebetween, with a binder affixing selected areas of said filaments to one another;

wherein adjacent surfaces of the first and second insert sections are configured to permit pivotal folding of the insert apparatus into a substantially L-shaped configuration as viewed in end view;

and wherein said apparatus is configured to substantially fill a portion of the gutter when placed therein, while leaving a substantially unobstructed water flow path between a wall of the insert body and the gutter.

2. The insert apparatus of claim 1, wherein the filaments comprise coconut shell fibers.

3. The insert apparatus of claim 1, wherein the filaments comprise a synthetic material.

4. The insert apparatus of claim 1, wherein the apparatus is configured to contact a gutter on at least three different surfaces thereof.

5. The insert apparatus of claim 1, wherein the bottom surface of the insert body has a void formed therein.

6. The insert apparatus of claim 1, wherein said cover sheet is formed from a foraminous screen material.

7. The insert apparatus of claim 6, wherein the screen material is formed from plastic to present a smooth surface.

8. The insert apparatus of claim 1, further comprising an elongated panel formed from a substantially solid material and adapted to be operatively attached to said gutter, wherein said solid panel covers said insert body.

9. The insert apparatus of claim 8, wherein said elongated panel is formed from plastic to present a smooth surface.

10. The insert apparatus of claim 8, wherein said elongated panel is formed with holes therein to allow water to pass therethrough.

11. The insert apparatus of claim 8, wherein said elongated panel comprises an outer, upwardly extending edge.

12. The insert apparatus of claim 8, further comprising grooves along an inner surface of said elongated panel for providing openings therein.

13. An insert apparatus for use with a rain gutter, said apparatus comprising:

an elongated insert body adapted to fit into a hollow channel of a gutter, and to contact the floor of the gutter when placed therein, said insert body having a substantially L-shaped cross-section in an installed configuration thereof and comprising a nonwoven mat comprising a plurality of filaments having open interstices defined therebetween, with a binder affixing selected areas of said filaments to one another; and a cover sheet attached to the top surface of the insert body, said cover sheet comprising a foraminous screen material.

14. The insert apparatus of claim 13, wherein the filaments comprise coconut shell fibers.

15. The insert apparatus of claim 13, wherein the filaments comprise a synthetic material.

16. The insert apparatus of claim 13, wherein the apparatus is configured to contact a gutter on at least three different surfaces thereof.

17. The insert apparatus of claim 13, wherein the insert body is configured to leave an open flow path therebelow when installed in a gutter.

18. The insert apparatus of claim 13, wherein the screen material is formed from plastic to present a smooth surface.

19. A method of lining a gutter with a porous gutter insert, comprising the steps of:

placing an elongated insert into a gutter channel in a manner so that when installed, the insert contacts the gutter on at least three sides of the insert, to cover the channel and to substantially fill part of the channel;

wherein the insert comprises:

an elongated insert body adapted to fit into a hollow channel of a gutter, and to contact the floor of the gutter when placed therein, said insert body comprising a first insert section, a second insert section, and a cover sheet attached to and interconnecting the first and second insert sections, said cover sheet formed of a bendable porous material, wherein each of said first and second insert sections comprises a nonwoven mat comprising a plurality of filaments having open interstices defined therebetween, with a binder affixing selected areas of said filaments to one another;

wherein adjacent surfaces of the first and second insert sections are configured to permit pivotal folding of the insert into a substantially L-shaped cross-sectional configuration;

and wherein said apparatus is configured to substantially fill a portion of the gutter when placed therein, while leaving a substantially unobstructed water flow path between a wall of the insert body and the gutter.

20. The method of claim 19, wherein the insert is substantially L-shaped in cross-section when installed, so that a lower portion thereof is spaced away from a wall of the gutter to leave an unobstructed flow path therein.

21. The method of claim 19, further comprising a step of sliding the insert below protective sleeves surrounding mounting nails for the gutter.

22. The method of claim 19, further comprising a step of placing an outermost top edge of the insert below an upper inwardly facing lip of the gutter.

* * * * *